United States Patent [19]

Webb

[11] Patent Number: 4,501,283

[45] Date of Patent: Feb. 26, 1985

[54] PLUG LOADER

[76] Inventor: James W. Webb, 2203 Grant Ave., Redondo Beach, Calif. 90278

[21] Appl. No.: 425,225

[22] Filed: Sep. 28, 1982

[51] Int. Cl.[3] ..... A24F 23/00

[52] U.S. Cl. ..... 131/329; 401/82

[58] Field of Search ..... 131/329; 73/429, 428; 433/80; 222/386; 401/82; 40/488, 490, 374

[56] References Cited

U.S. PATENT DOCUMENTS

| | | | |
|---|---|---|---|
| 138,281 | 4/1873 | Pflock | 73/429 |
| 241,864 | 5/1881 | Huner | 73/429 |
| 1,104,068 | 7/1914 | Norton | 131/329 |
| 2,272,924 | 2/1942 | Relchenbach | 401/82 |
| 2,558,998 | 7/1951 | Yearout | 73/429 |

FOREIGN PATENT DOCUMENTS

| | | | |
|---|---|---|---|
| 4887 | of 1910 | United Kingdom | 131/329 |

*Primary Examiner*—V. Millin
*Assistant Examiner*—Harry Macey
*Attorney, Agent, or Firm*—Roger A. Marrs

[57] ABSTRACT

A tobacco plug cutter and loader is disclosed herein having an elongated hollow sleeve enclosing a slidable plunger or ram member adapted to move between limit stops so as to determine the size of a storage cavity defined between the open end of the sleeve and adjacent end of the plunger. The limit stop includes an elongated slot in the side of the sleeve slidably receiving a stop pin for engaging with the opposite ends of the slot. The adjacent ends of the plunger and the sleeve are wedge-shaped to form a cutting edge for penetrating into a supply of semi-hardened product such as tobacco.

1 Claim, 4 Drawing Figures

FIG. 1
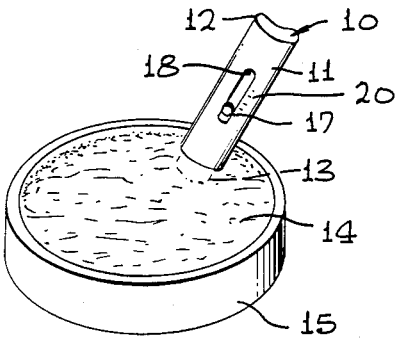
FIG. 2
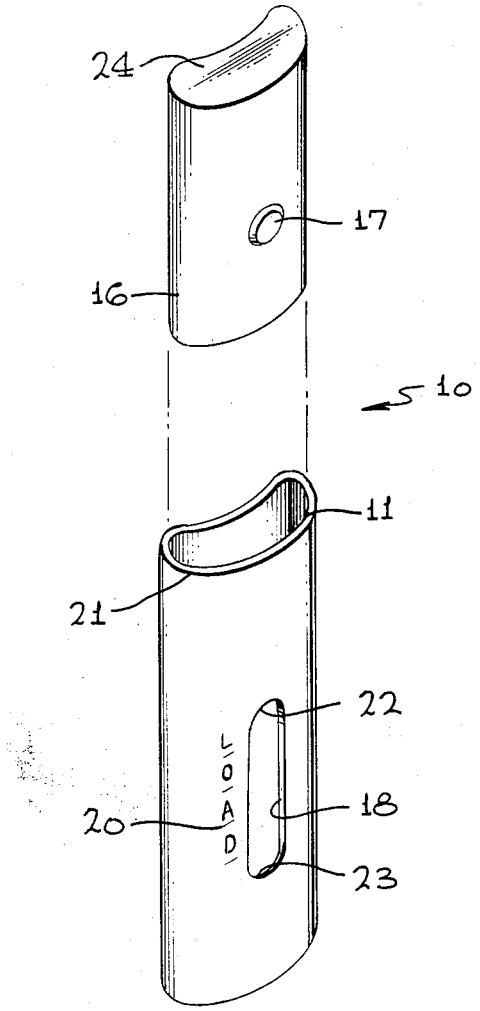
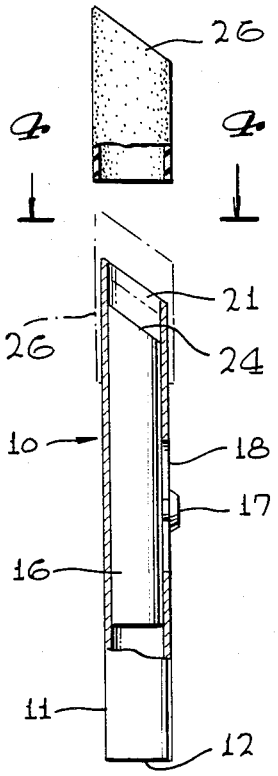
FIG. 3
FIG. 4
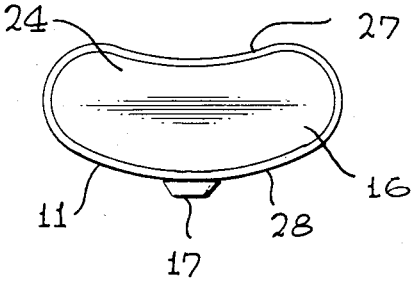

PLUG LOADER

BACKGROUND OF THE INVENTION

1. Field of the Invention

The present invention relates to tobacco plug cutters and loaders and is more particularly related to a novel plug loader adapted to separate a desired amount of tobacco from bulk storage and conveniently hold and convey the selected amount to the mouth of the user.

2. Brief Description of the Prior Art

It is the conventional practice to supply chewing tobacco in a tin or container from which the user may select a given amount by employing his fingers. Customarily, the user will open the bulk container and extract a certain amount of the tobacco, which is semi-hard, with his fingers and place the selected amount into his mouth. Although such a procedure has been satisfactory for a number of years, obvious difficulties and problems have arisen which reside in the fact that the user's fingers must be used.

Among the difficulties, it is noted that the tobacco product stains the fingers of the user as well as collects under the fingernails. Also, the fingers become moist when placed in the mouth which is unsanitary and requires the user to dry the fingers in some manner. Generally, the user does not select the same amount of tobacco product each time a desired amount is extracted from the bulk supply so that repeated taking of amounts of tobacco from the bulk is required.

Therefore, a long standing need has existed to provide a plug cutter and loader which is automatic in operation such that the user may separate a given quantity of product from bulk tobacco and which also may be used to feed the selected amount of product into the mouth of the user without the fingers entering the mouth.

SUMMARY OF THE INVENTION

Accordingly, the above problems and difficulties are obviated by the present invention which provides a novel tobacco plug cutter and loader which comprises an elongated housing taking the form of a sleeve closed at one end and open at its opposite end and a plunger which is slidably arranged on the inside of the sleeve so as to be positioned within the sleeve whereby one end of the plunger and the open end of the sleeve defines a cavity adapted to receive a selected amount of tobacco product. Limit means are provided in cooperation between the plunger and the sleeve whereby the sides of the cavity may be selectively arranged so that more or less of the tobacco product is introduced into the cavity and held by the loader. In one form of the invention, such limit means includes an elongated slot in the sidewall of the sleeve through which a projecting pin attached to the plunger passes and engages with the opposite ends of the slot constituting a range of movement for the plunger within the sleeve.

Adjacent ends of the plunger and sleeve are angled so as to provide ease in forcing entry into the bulk storage of the tobacco product so that a portion of the product enters the sized cavity. Selected indicia is provided adjacent the slot for indicating cavity size or which may be employed for advertising or other commericial character display.

Therefore, it is among the primary objects of the present invention to provide a novel cutter and loader for a tobacco product which eliminates the need for the user to use his fingers in selecting a desired quantity of this tobacco product and in placing the product in his mouth.

Another object of the present invention is to provide a tobacco plug cutter and loader which is simple to manufacture and economical to assemble and use.

Still a further object of the present invention is to provide a novel means by which a user may extract a selected quantity of tobacco product from bulk supply and place the quantity into his mouth without the use of his fingers.

Yet another object of the present invention is to provide a novel tobacco plug cutter and loader which employs a sliding member within a sleeve adapted to enter bulk storage of the tobacco product and to select a given quantity therefrom so that the quantity may be removed and introduced into the mouth of the user without the user having to use his fingers for direct contact with the selected amount of tobacco product.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a perspective view showing the novel plug loader of the present invention used in a typical procedure for extracting a plug of tobacco from its bulk storage;

FIG. 2 is an enlarged exploded perspective view of the novel plug loader shown in FIG. 1;

FIG. 3 is a longitudinal cross-sectional view of the novel plug loader shown in FIGS. 1 and 2; and FIG. 4 is a transverse cross-sectional view of the plug loader shown in FIG. 3 as taken in the direction of arrows 44 thereof.

DESCRIPTION OF PREFERRED EMBODIMENT

Referring to FIG. 1, the novel plug loader of the present invention is shown in the general direction of arrow 10 which includes an elongated hollow sleeve 11 closed at end 12 which is illustrated in a procedure for extracting a selected amount of tobacco product broadly identified by numeral 13 from a bulk supply 14 contained within a tin or container 15. The bulk product tobacco is semi-moist or hard and is generally removed by use of the fingers of the user. However, the present invention incorporates a plunger or ram member 16 slidably carried within the interior of the sleeve 11. The plunger 16 includes a pin type indicator 17 which projects through a slot 18 and is employed with reference to a printed or inscribed scale 20 representative of a selected quantity of tobacco product or plug intended to be extracted from the bulk 14.

Referring now in detail to FIG. 2, it can be seen that the plunger 16 is of shorter length of the overall length of the sleeve 11 and that the end 21 of the sleeve is open ended so as to slidably receive the insertion of the plunger 16. The pin 17 projects through the slot 18 and the pin engages with the opposite ends 22 and 23 of the slot which serve as limit stops for terminating the travel of the plunger 16 within the sleeve 11.

FIG. 2 also illustrates that the plunger 16 is preferably of a solid mass terminating in a forward end 24 that directly engages with the selected amount of tobacco product when the sleeve 11 has been inserted into the bulk 14.

FIG. 2 also illustrates that the indicia 20 may include a scale cooperatively related with respect to the pin 17 which in turn relates the distance of the end 24 of the plunger 16 with the end 21 of the sleeve 11. The indicia may also be of a commercial advertising nature so that slogans, product names or the like may be centrally located on the sleeve for customer review.

Referring now in detail to FIG. 3, the sleeve 11 may include a removable cap 26 which closes end 21 of the sleeve when not in use. Also, it can be seen that both the sleeve end 21 and the end 24 of the plunger are angled in parallel relationship to one another so that the sleeve will readily cut into the bulk product 14 when manually forced by the user. Therefore, the selected amount of the tobacco product is forced into the cavity defined by the inner sidewall surfaces of the sleeve 11 between the angled end 24 of the plunger 16 and the terminating angled edge 21 of the sleeve 11. The size of this cavity is related to the position of the pin 17 along the length of the slot 18.

Once the selected amount of tobacco product has been forced into the sized cavity of the sleeve, the device 10 is removed from the bulk product 14 so that the selected amount of tobacco product is separated therefrom and contained in the loader 10. When it is desired for the user to induce the tobacco into his mouth, the user urges the plunger forward by engaging his thumb with the pin 17 so that the selected tobacco plug or product is forcibly urged out of the sleeve into the mouth of the user. Therefore, the user's fingers never touch or come into contact with the tobacco product or the mouth of the user.

Referring now in detail to FIG. 4, it can be seen that the sleeve 11 is rounded at its sides and includes an arcuate front portion in which the slot 18 is provided and a rear arcuate portion indicated by numeral 27 which is substantially parallel to and lies on the same radius of the front portion of the sleeve 11 as identified by numeral 28. Such an arrangement provides for guided and improved plunger 16 movement within the confines of the sleeve 11.

Therefore, in actual operation, it can be seen that the plug loader of the present invention is a convenient tool for selecting a portion of the tobacco product from the bulk 14 and for holding the selected portion in a convenient manner until discharged into the mouth of the user. The user merely engages the pin 17 with his thumb for selecting the plug size by visually aligning the pin 17 with indicia located alongside the slot 18. The edge 21 of the sleeve 11 readily enters into the bulk 14 and because of the angle or wedge shape of the edge, the selected portion of the product is easily forced into the sized cavity so that the product bears against the angled surface 24 of the plunger.

It is noticed that the wedged end includes a radius in addition to the angle so as to fit and conform with the shape of the mouth of the user. Such a shape presents a comfortable feel to the user.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A plug loader for withdrawing a quantity of tobacco from a bulk supply and delivering the tobacco to the mouth of the user comprising the combination of:

an elongated hollow sleeve of oblong transverse cross-section having front and back walls and being open at a forward end and closed at its opposite end;

a plunger of oblong transverse cross-section having a closed end facing said sleeve open end slidably disposed in said sleeve for moving between said open and said closed ends and substantially occupying the hollow of said sleeve;

means cooperatively carried between said sleeve and said plunger for limiting movement of said plunger so as to establish a cavity of predetermined volume defined between said closed end of said plunger and said sleeve open end;

said plunger and said sleeve have concentric semi-circular arcuate cross-sections so that said predetermined volume cavity is of a similar arcuate defined configuration;

said limiting means comprise a slot in the side of said sleeve and a pin carried on said plunger projecting through said slot adapted to selectively engage with the opposite ends of said sleeve slot to restrict movement of said plunger;

indicia carried on said sleeve adjacent to said slot cooperating with said plunger pin to indicate the size of said cavity;

said plunger closed end and sleeve open end associated at said sleeve open end are slanted in parallel relationship extending from the back of said sleeve to the front provided with said slot, thereby forming a wedge shape;

said slanted open end of said sleeve constituting a cutting means for introducing a tobacco product into said cavity against said slanted end of said plunger; and a cap detachably connected to said sleeve open end for closing access to said cavity.

* * * * *